US006299020B1

(12) United States Patent
Sudolcan et al.

(10) Patent No.: US 6,299,020 B1
(45) Date of Patent: Oct. 9, 2001

(54) BEVERAGE DISPENSER SENSOR SYSTEM

(75) Inventors: Paul S. Sudolcan, Seguin; Thomas J. Chadwell, San Antonio, both of TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 0 days.

(21) Appl. No.: 09/425,648

(22) Filed: Oct. 22, 1999

(51) Int. Cl.[7] ..... B67B 7/00
(52) U.S. Cl. ..... 222/1; 222/52; 222/64
(58) Field of Search ..... 222/64, 52, 1

(56) References Cited

U.S. PATENT DOCUMENTS 3,662,924 * 5/1972 Crandall et al. ..... 222/64
4,319,568 * 3/1982 Tregoning ..... 222/64
4,503,994 * 3/1985 Pyle ..... 222/64
5,852,946 * 12/1998 Cowger ..... 222/64
6,112,946 * 9/2000 Bennett et al. ..... 222/64

* cited by examiner

*Primary Examiner*—Kevin Shaver
*Assistant Examiner*—Patrick Buechner
(74) *Attorney, Agent, or Firm*—Christopher L. Makay

(57) ABSTRACT

A beverage dispenser sensor system for detecting beverage fluid in a beverage dispenser includes at least a first sensing unit in engagement with the beverage dispenser for measuring fluid and for generating a first sensing unit measurement signal and a processor linked with the first sensing unit for receiving the first sensing unit measurement signals. The beverage dispenser sensor system further includes an indicator that announces the beverage fluid needs replenishing if the processor assesses from the first sensing unit measurement signal little or a lack of beverage fluid in the beverage dispenser. Furthermore, the beverage dispenser sensor system may include a second sensing unit in engagement with the beverage dispenser for measuring fluid and for generating a second sensing unit measurement signal received by the processor to determine little or a lack of beverage fluid in the beverage dispenser.

39 Claims, 3 Drawing Sheets

BEVERAGE DISPENSER SENSOR SYSTEM

BACKGROUND OF THE INVENTION

1. Field of the Invention

The present invention generally relates to dispensing equipment and, more particularly, but not by way of limitation, to a sensor system for a beverage dispenser that reliably detects fluid regardless of the beverage fluid type.

2. Description of the Related Art

Beverage dispensers often operate by combining beverage fluids to form a desired drink, such as lemonade, orange juice, cola, and the like. Typically, a beverage concentrate is combined with a mixing fluid, such as water, to form a desired drink. The beverage dispenser draws each of the beverage fluids from a respective external source.

As such, the desired drink is dispensed from the beverage dispenser through a dispensing valve. Beverage fluid lines are provided by the beverage dispenser to ultimately deliver each beverage fluid from the external source to the dispensing valves.

Beverage dispensers, and in particular juice dispensers, often include a conductivity sensor system for detecting beverage fluids travelling from an external source to respective beverage fluid lines. Inasmuch, if little or a lack of fluid is detected for a particular beverage fluid, the beverage dispenser will indicate that such beverage fluid needs to be sufficiently replenished to thus continue operation.

In many instances, however, a conductivity sensor system is difficult to maintain and does not provide reliable measurements. For example, a conductivity sensor system sensing the amount of beverage concentrate in an external source often furnishes an empty indication although there is beverage concentrate remaining. Furthermore, beverage concentrate for viscous juices such as orange juice often accumulates on a conductivity sensor system's measuring probes such that these probes do not operate properly and require frequent cleaning. Accordingly, there is a long felt need for a beverage dispenser sensor system that reliably detects fluid for any beverage fluid type and that requires little need for maintenance and recalibration.

SUMMARY OF THE INVENTION

A beverage dispenser sensor system for detecting beverage fluid in a beverage dispenser includes at least a first sensing Unit in engagement with the beverage dispenser for detecting fluid and for generating a first sensing unit measurement signal and a processor linked with the first sensing unit for receiving the first sensing unit measurement signal. The beverage dispenser sensor system further includes an indicator that announces the beverage fluid needs replenishing if the processor assesses from the first sensing unit measurement signal little or a lack of beverage fluid in the beverage dispenser. Furthermore, the beverage dispenser sensor system may include a second sensing unit in engagement with the beverage dispenser for detecting fluid and for generating a second sensing unit measurement signal received by the processor to determine little or a lack of beverage fluid in the beverage dispenser.

The first sensing unit includes a phototransmitter linked with the processor and in engagement with the beverage fluid within the beverage dispenser for emitting an electromagnetic radiation signal through the beverage fluid. The first sensing unit further includes a photodetector linked with the processor and in engagement with the beverage fluid within the beverage dispenser for receiving the electromagnetic radiation signal.

The second sensing unit includes a first electrode and a second electrode each in engagement with beverage fluid within the beverage dispenser and linked with the processor. The first sensing unit further includes an electrolyte, which is the beverage fluid in the beverage dispenser, intermediate the first and second electrodes for establishing a conducting path therebetween.

A method for detecting beverage fluid in a beverage dispenser includes the steps of linking at least a first sensing unit with the beverage dispenser, linking a processor with the first sensing unit, measuring fluid in the beverage dispenser with the first sensing unit, and generating a first sensing unit measurement signal, whereby the signal is received by the processor. Furthermore, the method may include the steps of linking a second sensing unit with the beverage dispenser, linking the processor with the second sensing unit, measuring fluid in the beverage dispenser with the second sensing unit, and generating a second sensing unit measurement signal, whereby the signal is received by the processor. The method further includes the steps of emitting an electromagnetic radiation signal through the beverage fluid with a phototransmitter of the first sensing unit, and capturing the electromagnetic signal with a photodetector, thereby detecting beverage fluid; and establishing a conducting path between first and second electrodes of the second sensing unit via an electrolyte to detect beverage fluid. The method still further includes the step of transmitting the indicator signal from the processor to an indicator linked with the processor, whereby the indicator announces that beverage fluid needs to be replenished if the processor assesses from the indicator signal little or a lack of beverage fluid in the beverage dispenser.

It is therefore an object of the present invention to provide a beverage dispenser sensor system that reliably detects fluid for any beverage fluid type and that requires little need for maintenance and recalibration.

Still other objects, features, and advantages of the present invention will become evident to those skilled in the art in light of the following.

DETAILED DESCRIPTION OF THE PREFERRED EMBODIMENT

As required, detailed embodiments of the present invention are disclosed herein, however, it is to be understood that the disclosed embodiments are merely exemplary of the invention, which may be embodied in various forms; the figures are riot necessarily to scale; and some features may be exaggerated to show details of particular components or steps.

Figure 1:
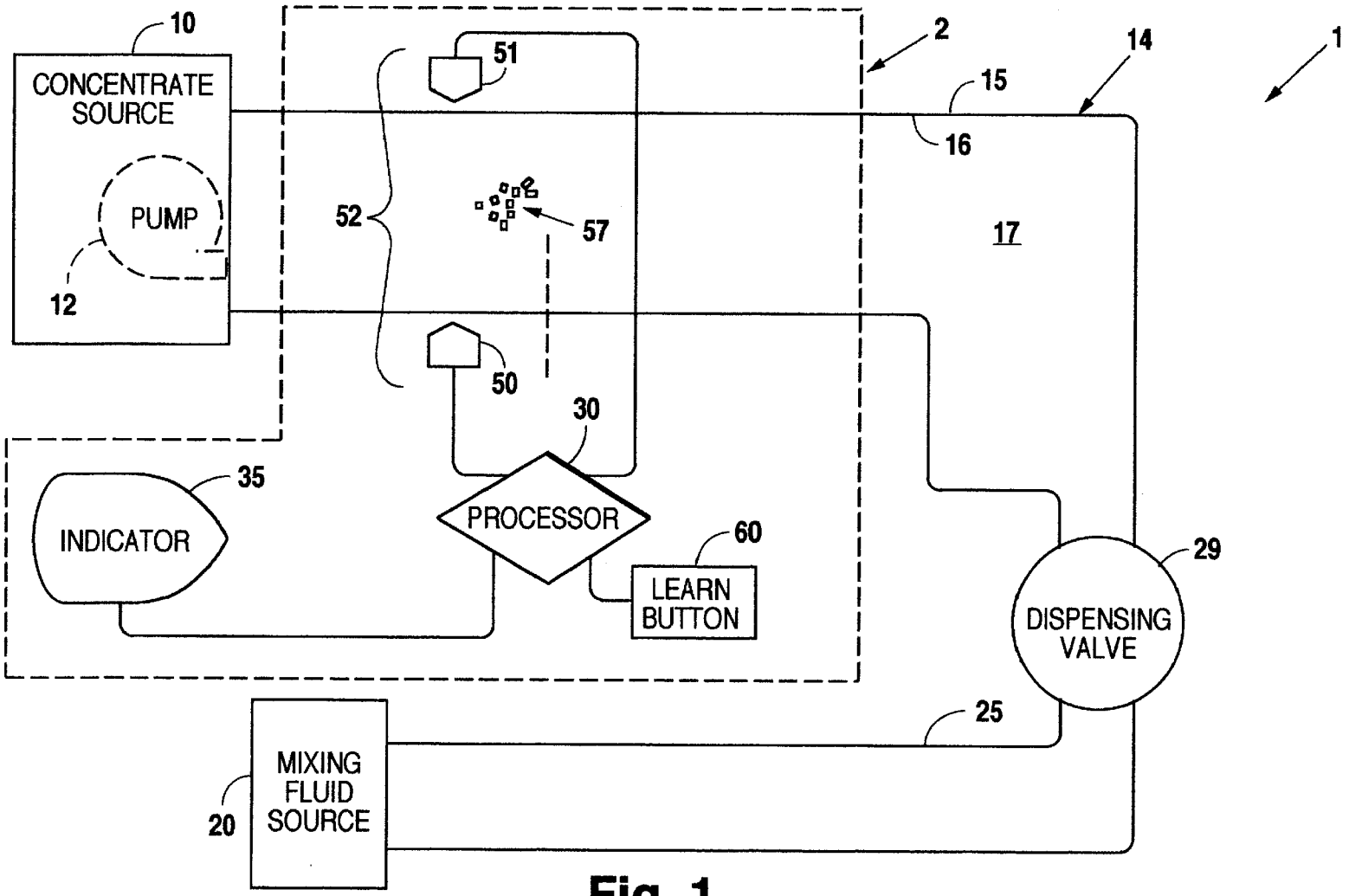
FIG. 1 is a schematic diagram illustrating a preferred embodiment for a beverage dispenser sensor system integrated with a beverage fluid line for detecting fluid.
Figure 2:
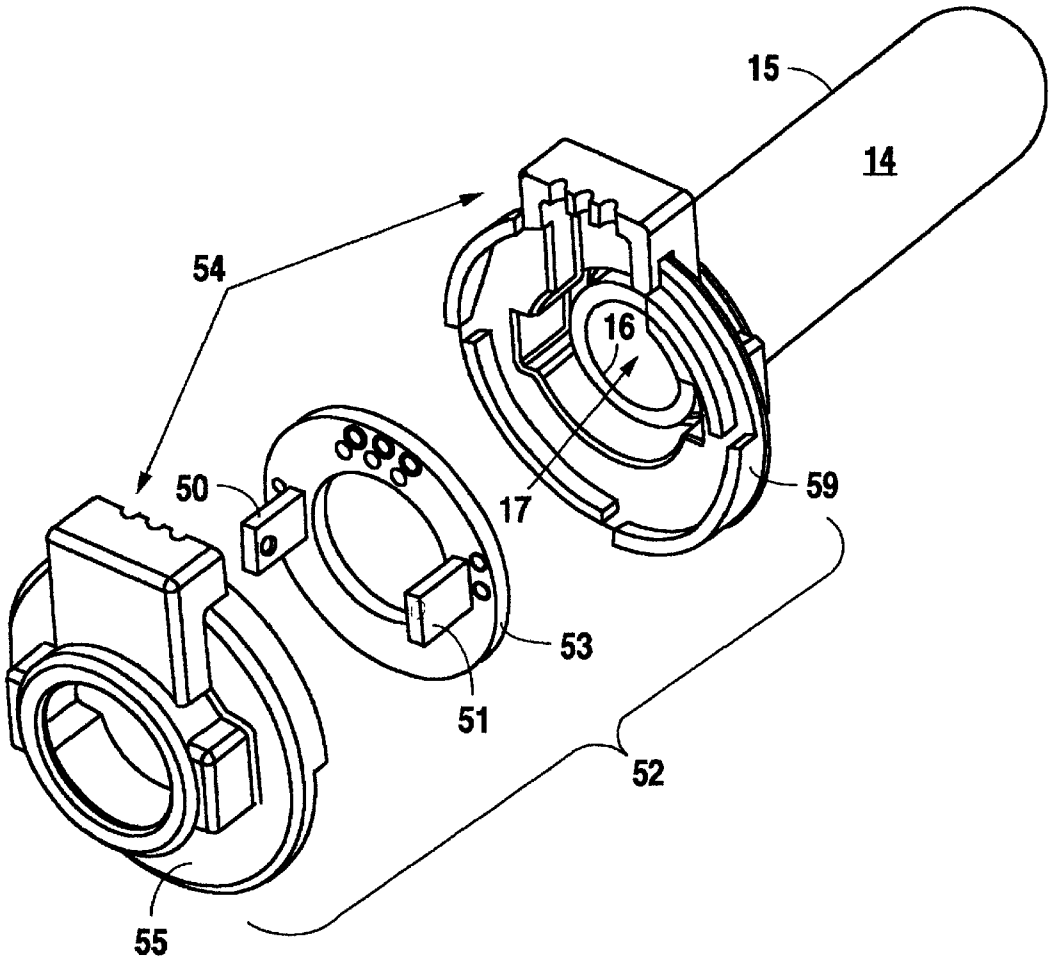
FIG. 2 is a perspective view illustrating a first sensing unit for the beverage dispenser sensor system.

FIG. 1 illustrates a beverage dispenser sensor system 2 for detecting fluid in a beverage dispenser 1, and FIG. 2 illustrates a first sensing unit 52 of the beverage dispenser sensor system 2. Inasmuch, if the beverage dispenser sensor system 2 detects little or a lack of a particular beverage fluid, the beverage dispenser 1 will indicate that such beverage fluid needs to be sufficiently replenished to continue operation.

Beverage dispenser 1 in the preferred embodiment is a standard beverage dispenser known in the industry, such as a juice dispenser. As such, beverage dispenser 1 combines beverage fluids to form a desired drink, such as lemonade, orange juice, and the like. In particular, beverage concentrate is combined with a mixing fluid., such as water, to form a desired drink. The beverage dispenser 1 draws beverage concentrate from a concentrate source 10 via a pump 12. Similarly, the beverage dispenser 1 draws mixing fluid from a mixing fluid source 20.

A desired drink is dispensed from the beverage dispenser 1 through a dispensing valve 29. Beverage dispenser 1 provides a first beverage fluid line 14 to deliver beverage concentrate from the concentrate source 10 to the dispensing valve 29. Beverage fluid line 14 includes an exterior surface 15, an interior surface 16, and a passageway 17 defined by the interior surface 16 through which beverage fluid flows. Similarly, a second beverage fluid line 25 is provided by the beverage dispenser 1 to deliver a mixing fluid from the mixing fluid source 20 to the dispensing valve 29.

Although other embodiments contemplate a beverage dispenser sensor system integrated with other beverage fluid lines, FIGS. 1 and 2 show the beverage dispenser sensor system 2 integrated with the first beverage fluid line 14 as is preferred. The beverage dispenser sensor system 2 includes a first sensing unit 52 engaged with the beverage fluid line 14 for measuring beverage fluid and for generating a measurement signal.

The first sensing unit 52, in this preferred embodiment, is a photoelectric device that measures the intensity of electromagnetic radiation (e.g., infrared) transmitted across a beverage concentrate in the beverage fluid line 14. The first sensing unit 52 includes a phototransmitter 50 electrically linked with a processor 30 and adjacent to the beverage fluid line 14 for transmitting an electromagnetic radiation signal across the passageway 17. In this preferred embodiment, the phototransmitter 50 is a light emitting diode. The first sensing unit 52 further includes a photodetector 51 electrically linked with the processor 30 and adjacent to the beverage fluid line 14 for receiving the electromagnetic radiation signal traveling across the passageway 17.

The phototransmitter 50 and photodetector 51 mount onto a support 53, which maintains the phototransmitter 50 and photodetector 51 in opposed relationship about the beverage fluid line 14. A first housing member 55 and a second housing member 59 snap fit over the support 53 to provide a housing 54 of the first sensing unit 52. The support 53 and housing 54 each define an aperture that permits the placement of the beverage fluid line 14 therethrough to maintain the phototransmitter 50 and the photodetector 51 spaced across the beverage fluid line 14. Although this preferred embodiment contemplates that the phototransmitter 50 and photodetector 51 are positioned in opposed relationship, one of ordinary skill in the art will recognize that the phototiansmitter 50 and photodetector 51 could be positioned adjacent one another and operatively linked through a reflector positioned in opposed relationship.

In operation, the phototransmitter 50 transmits an electromagnetic radiation signal across the passageway 17, which is received by the photodetector 51. As long as beverage concentrate resides within the beverage fluid line 14, the electromagnetic radiation signal received by the photodetector 51 remains substantially constant, indicating the concentrate source 10 contains beverage concentrate. However, when the concentrate source 10 empties, the pump 12 draws air into the beverage fluid line 14, thereby creating bubbles 57. The bubbles 57, due to the principles of refraction and reflection, interfere with the electromagnetic radiation signal transmitted from the phototransmitter 50, resulting in a measurable change in the intensity of the electromagnetic radiation signal received by the photodetector 51. Consequently, the photodetector 51 outputs a signal indicating that the concentrate source 10 is empty and needs replacement.

The beverage dispenser sensor system 2 includes the processor 30 linked with the first sensing unit 52 for operating the phototransmitter 50, for receiving measurement signals from the photodetector 51, for determining whether such measurement signals indicate little or no fluid, and for generating an indicator signal accordingly. The beverage dispenser sensor system 2 further includes an indicator 35 coupled with the processor 30 for receiving indicator signals and indicating the operational status of the beverage dispenser 1 as a function of fluid. In particular, if an indicator signal conveys little or a lack of beverage concentrate in the first beverage fluid line 14, the indicator 35 will announce that beverage concentrate needs to be replenished to continue operation. Similarly, if an indicator signal coveys sufficient fluid in the first beverage fluid line 14, the indicator 35 will announce accordingly. Indicator 35 in the preferred embodiment includes a light and/or sonic alarm for indicating the operational status of the beverage dispenser 1.

The beverage dispenser sensor system 2 includes a learn feature implemented through a learn button 60. After a concentrate source 10 has been placed in the beverage dispenser 1 and beverage concentrate is within the beverage fluid line 14, the learn button is pressed, resulting in the processor 30 entering a learn mode. In the learn mode, the processor 30 engages the phototransmitter 50, reads a predetermined number of measurement signals (at least one hundred in this preferred embodiment) received from the photodetector 51, averages the predetermined number of measurement signals to develop a sufficient fluid signal, and stores the sufficient fluid signal for later comparison with operating measurement signals to determine when the concentrate source 10 is empty. Although it is desirable to always develop a new sufficient fluid signal with each replenishment of concentrate, failure to do so will result in the re-use of the existing sufficient fluid signal.

Accordingly, in operation, beverage concentrate is pumped, via pump 12, from the concentrate source 10 to the dispensing valve 29 across the passageway 17. The first sensing unit detects the intensity of the electromagnetic radiation signal transmitted across the beverage concentrate, whereby the phototransmitter 50 emits the electromagnetic radiation signal across the passageway 17 and the photodetector 51 receives such measurement signals. As such, the measurement signals are read by the processor 30, which determines whether there are significant changes in intensity thereof by comparing the measurement signals to the sufficient fluid signal. When the processor 30 determines the measurement signals do not substantially equal the sufficient fluid signal, the processor 30 sends a corresponding indicator signal to the indicator 35 conveying little or lack of fluid in the passageway 17. On receiving such signals, the indicator 35 will announce that beverage concentrate needs to be replenished to continue operation. Similarly, if an indicator signal coveys sufficient fluid in the passageway 17, the indicator 35 will announce accordingly. Although this preferred embodiment detects fluid based on a comparison, one of ordinary skill in the art will recognize that the processor 30 could include a look-up table or other calculation method to ascertain the exact fluid level within the beverage fluid line 14.

Figure 3:
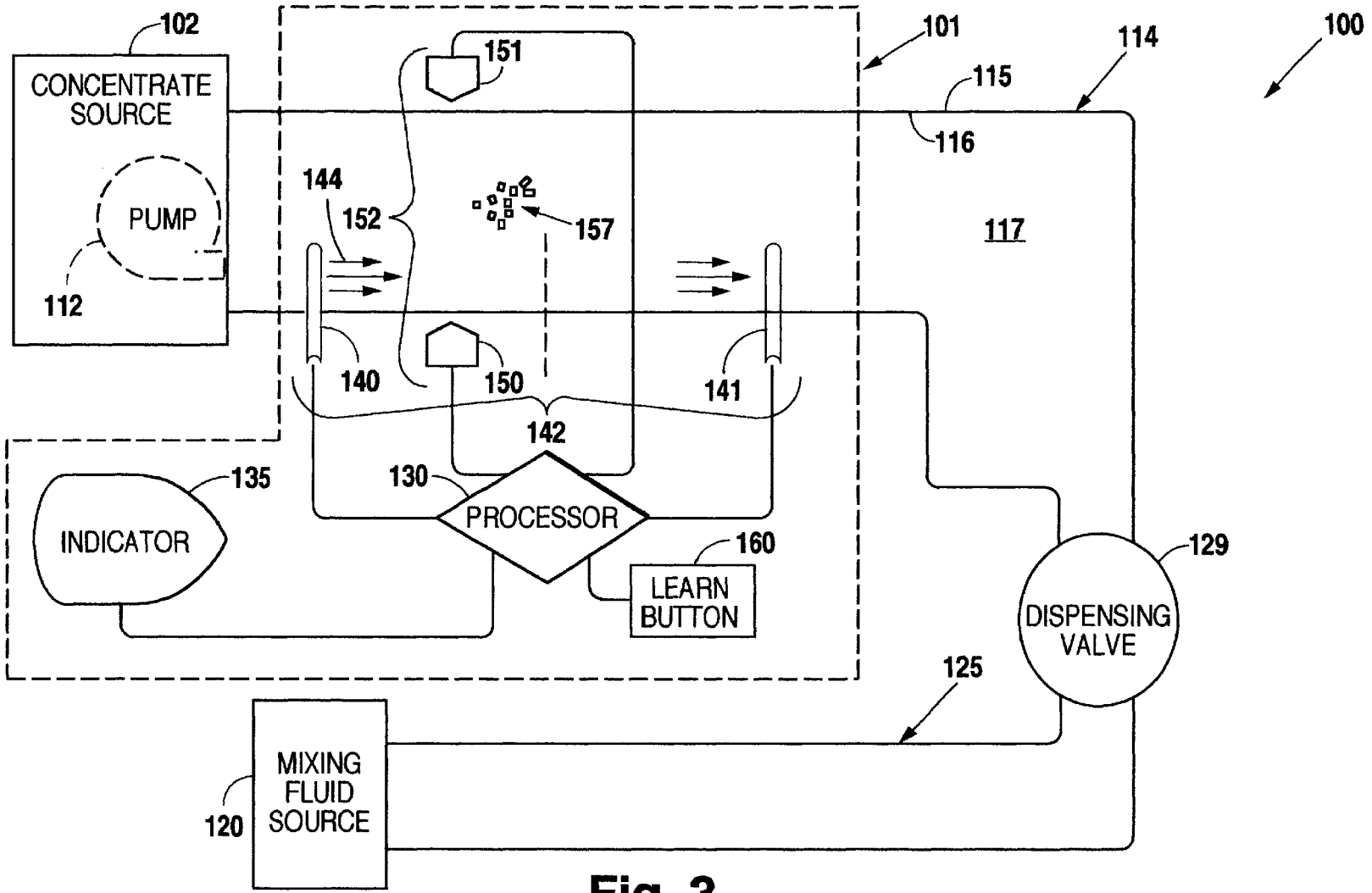
FIG. 3 is a schematic diagram illustrating an alternative embodiment for a beverage dispenser sensor system integrated with a beverage fluid line for detecting fluid.

FIG. 3 illustrates an alternative beverage dispenser sensor system 101 for detecting fluid in a beverage dispenser 100. Inasmuch, if the beverage dispenser sensor system 101 detects little or a lack of fluid for a particular beverage fluid, the beverage dispenser 100 will indicate that such beverage fluid needs to be sufficiently replenished to continue operation. Beverage dispenser 100 in this alternative embodiment is identical to beverage dispenser 1 of the preferred embodiment. In particular, beverage concentrate is combined with a mixing fluid, such as water, to form a desired beverage drink. The beverage dispenser 100 draws beverage concentrate from a concentrate source 102 via a pump 112. Similarly, the beverage dispenser 1 draws mixing fluid from a fluid mixing source 120.

A desired beverage drink is dispensed from the beverage dispenser 100 through a dispensing valve 129. Beverage dispenser 100 provides a first beverage fluid line 114 to deliver beverage concentrate from the concentrate source 102 to the dispensing valve 129. Beverage fluid line 114 includes an exterior surface 115, an interior surface 116, and a passageway 117 defined by the interior surface 116 through which beverage fluid flows. Similarly, a second beverage fluid line 125 is provided by the beverage dispenser 100 to deliver a mixing fluid from the mixing fluid source 120 to the dispensing valve 129.

Although other embodiments contemplate a beverage dispenser sensor system integrated with other beverage fluid lines, FIG. 3 shows the beverage dispenser sensor system 101 integrated with the first beverage fluid line 114 as is preferred. The beverage dispenser sensor system 101 includes a first sensing unit 152 and a second sensing unit 142 each engaged with the beverage fluid line 114 for measuring fluid and for generating a measurement signal. The beverage dispenser sensor system 101 includes a processor 130 linked with the first sensing unit 152 and the second sensing unit 142 for receiving measurement signals, for determining whether such signals indicate little or no fluid, and for generating an indicator signal accordingly.

The beverage dispenser sensor system 101 further includes an indicator 135 coupled with the processor 130 for receiving indicator signals and indicating the operational status of the beverage dispenser 100 as a function of fluid. In particular, if an indicator signal conveys little or a lack of beverage concentrate in the first beverage fluid line 114, the indicator 135 will announce that beverage concentrate needs, to be replenished to continue operation. Similarly, if an indicator signal conveys sufficient fluid in the first beverage fluid line 114, the indicator 135 will announce accordingly. Indicator 135 in the preferred embodiment includes a light and/or sonic alarm for indicating the operational status of the beverage dispenser 100.

The first sensing unit 152 is identical in component parts and operation to the first sensing unit 52 of the preferred embodiment. Accordingly, an operative description of phototransmitter 150 and photodetector 151, including their detection of bubbles 157, and of learn button 160 will not be provided herein.

The second sensing unit 142 is an electrochemical device that establishes a conducting path across the beverage concentrate to detect fluid. Thus, for example, a break along a conducting path would signify insufficient fluid in that there is not enough beverage concentrate available within a passageway to maintain a continuous conducting path.

The second sensing unit 142 includes a first electrode 140 and a second electrode 141, each in engagement with the processor 130 and extending from the inner surface 116 into the passageway 117 of the first beverage fluid line 114. The second sensing unit includes an electrolyte 144 intermediate the first and second electrodes 140, 141 for establishing a continuous conducting path therebetween. Although one of ordinary skill in the art will recognize other suitable and equivalent means for establishing a conducing path as a function of beverage fluid, electrolyte 144 in this alternative embodiment is beverage concentrate within the passageway 117, whereby electroconductive properties inherent to beverage concentrate thus establish a conducting path. Furthermore, in this preferred embodiment, the first electrode 140 is an anode and the second electrode 141 is a cathode.

In this alternative embodiment, it is important that the first sensing unit and the second sensing unit be in cooperative engagement with one another. Inasmuch, the first sensing unit better operates for opaque, viscous beverage fluids, such as orange beverage concentrate, whereby discrepancies from an established intensity reading are easier to measure than with less opaque beverage fluids, such as lemonade. On the other hand, the second sensing unit measures for current and thus better operates in less viscous beverage fluids which are typically less opaque. Therefore, linking the first sensing unit in operative engagement with the second sensing unit enables the processor 130 to detect fluid for any beverage fluid without the necessity of calibration to compensate for beverage fluid opaqueness.

Accordingly, in operation, beverage concentrate is pumped, via pump 112, from the concentrate source 102 to the dispensing valve 129 across passageway 117. In effect, the beverage concentrate acts as an electrolyte and thus establishes a continuous conductive path between the first and second electrodes 140, 141 of the second sensing unit. A second sensing unit measurement signal is generated therefrom and is received by the processor 130 for determining whether there are significant breaks across the conducting path. The first sensing unit detects intensity of electromagnetic radiation across the beverage concentrate, whereby the phototransmitter 150 emits an electromagnetic radiation signal across the passageway 117 and the photodetector 151 receives such signal. As such, first sensing unit measurement signals are generated therefrom and are received by the processor 130, which utilizes the sufficient fluid signal to determine whether there are significant changes in intensity thereof.

If the processor 130 identifies from the second sensing unit measurement signals the existence of a significant break across the conducting path, the processor 130 will send a corresponding indicator signal to the indicator 135 conveying little or lack of fluid in the passageway 117. If the processor 130 identifies from the first sensing unit measurement signal the existence of a significant change in intensity, the processor 130 will send a corresponding indicator signal to the indicator 135 conveying little or lack of fluid in the passageway 117. On receiving such signals, the indicator 135 will announce that beverage concentrate needs to be replenished to continue operation. Similarly, if an indicator signal coveys sufficient fluid in the passageway 117, the indicator 135 will announce accordingly.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims that follow.

We claim:

1. A method for detecting beverage fluid in a beverage fluid line of a beverage dispenser, comprising the steps of:

linking a photoelectric device with the beverage fluid line;

linking a processor with the photoelectric device;

producing a measurement signal representative of fluid in the beverage fluid line utilizing the photoelectric device;

reading a plurality of the measurement signals and developing a fluid signal therefrom when there is fluid in the beverage fluid line; and comparing the developed fluid signal to a subsequent measurement signal, thereby determining fluid level within the beverage fluid line.

2. The method according to claim 1 wherein developing a fluid signal comprises the step of averaging the plurality of the measurement signals.

3. The method according to claim 1 wherein the photoelectric device comprises:

a phototransmitter linked with the processor and operatively engaged with the beverage fluid line for emitting an electromagnetic radiation signal through the beverage fluid; and a photodetector linked with the processor and operatively engaged with the beverage fluid line for receiving the electromagnetic radiation signal.

4. The method according to claim 3 further comprising the step of:

emitting an electromagnetic radiation signal through the beverage fluid within the beverage fluid line using the phototransmitter; and capturing the electromagnetic signal with the photodetector.

5. The method according to claim 1 further comprising the steps of:

developing an indicator signal by assessing beverage fluid level using the measurement signal; and transmitting the indicator signal from the processor to an indicator linked with the processor.

6. The method according to claim 5 further comprising the step of indicating with the indicator the operational status of the beverage dispenser as a function of fluid level.

7. The method according to claim 6 further comprising the step of announcing that beverage fluid needs to be replenished with the indicator if the processor assesses from the indicator signal little or a lack of beverage fluid in the beverage fluid line.

8. A method for detecting beverage fluid in a beverage fluid line of a beverage dispenser, comprising the steps of:

linking a photoelectric device with the beverage fluid line;

linking a conductivity sensing unit with the beverage fluid line;

linking a processor with the photoelectric device and with the conductivity sensing unit; and measuring fluid in the beverage fluid line with the photoelectric device and the conductivity sensing unit and generating a first measurement signal and a second measurement signal, respectively, whereby each signal is received by the processor.

9. The method according to claim 8 further comprising the step of linking the photoelectric device and the conductivity sensing unit in cooperative engagement via the processor.

10. The method according to claim 8 wherein the photoelectric device comprises:

a phototransmitter linked with the processor and in engagement with beverage fluid within the beverage fluid line; and a photodetector linked with the processor and in engagement with beverage fluid within the beverage fluid line.

11. The method according to claim 10 further comprising the step of:

emitting an electromagnetic radiation signal through the beverage fluid with the phototransmitter; and capturing the electromagnetic signal with the photodetector.

12. The method according to claim 8 wherein the conductivity sensing unit comprises:

a first electrode and a second electrode each in engagement with beverage fluid within the beverage fluid line and linked with the processor; and an electrolyte intermediate the first and second electrodes.

13. The method according to claim 12 further comprising the step of establishing a conducting path between the first and second electrodes of the conductivity sensing unit via the electrolyte to determine beverage fluid level.

14. The method according to claim 8 further comprising the step of transmitting the indicator signal from the processor to an indicator linked with the processor.

15. The method according to claim 14 further comprising the step of indicating the operational status of the beverage dispenser as a function of fluid level with the indicator.

16. The method according to claim 15 further comprising the step of announcing that beverage fluid needs to be replenished with the indicator if the processor assesses from the indicator signal little or a lack of beverage fluid in the beverage fluid line.

17. A beverage dispenser sensor system for detecting beverage fluid in a beverage fluid line of a beverage dispenser, comprising:

a photoelectric device operatively engaged with the beverage fluid line for producing a measurement signal representative of fluid in the beverage fluid line; and a processor linked with the photoelectric device for receiving the measurement signal, wherein the processor develops a fluid signal from a plurality of measurement signals when there is fluid in the beverage fluid line, and further wherein the processor compares the developed fluid signal to a subsequent measurement signal, thereby determining fluid level within the beverage fluid line.

18. The beverage dispenser sensor system according to claim 17 wherein the processor develops the fluid signal by reading a plurality of measurement signals from the photoelectric device when there is fluid in the beverage fluid line and averaging the plurality of measurement signals, thereby producing the fluid signal.

19. The beverage dispenser sensor system according to claim 1, further comprising a learn button depressed to trigger the development of the fluid signal by the processor.

20. The beverage dispenser sensor system according to claim 17 wherein the photoelectric device comprises:

a phototransmitter linked with the processor and operatively engaged with the beverage fluid line for emitting an electromagnetic radiation signal through the beverage fluid; and a photodetector linked with the processor and operatively engaged with the beverage fluid line for receiving the electromagnetic radiation signal.

21. The beverage dispenser sensor system according to claim 20 wherein the photoelectric device further comprises.

a support for the phototransmitter and the photodetector; and a housing for the support, wherein the housing and the support maintain the phototransmitter and the photodetector positioned about the beverage fluid line.

22. The beverage dispenser sensor system according to claim 17 wherein the processor assesses beverage fluid level from the measurement signal and generates a corresponding indicator signal.

23. The beverage dispenser sensor system according to claim 22 wherein the indicator announces that beverage fluid needs to be replenished if the processor assesses from the indicator signal little or a lack of beverage fluid in the beverage fluid line.

24. The beverage dispenser sensor system according to claim 22 further comprising an indicator linked with the processor for receiving indicator signals therefrom.

25. The beverage dispenser sensor system according to claim 24 wherein the indicator indicates the operational status of the beverage dispenser as a function of fluid level.

26. A beverage dispenser including a beverage dispenser sensor system, comprising:

a dispensing valve;

a concentrate source coupled with the dispensing valve via a concentrate line;

a mixing fluid source coupled with the dispensing valve via a mixing fluid line;

a photoelectric device operatively engaged with the concentrate line for producing a measurement signal representative of fluid in the concentrate line; and a processor linked with the photoelectric device for receiving the measurement signal and for determining fluid level within the concentrate line utilizing the measurement signal.

27. The beverage dispenser according to claim 26 wherein the processor determines the fluid level in the concentrate line by comparing the measurement signal to a fluid signal.

28. The beverage dispenser sensor system according to claim 27 wherein the processor develops the fluid signal by reading a plurality of measurement signals from the photoelectric device when there is fluid in the beverage fluid line and averaging the plurality of measurement signals, thereby producing the fluid signal.

29. The beverage dispenser according to claim 28 further comprising a learn button depressed to trigger the development of the sufficient fluid signal by the processor.

30. A beverage dispenser sensor system for detecting beverage fluid in a beverage fluid line of a beverage dispenser, comprising:

a photoelectric device engaged with the beverage fluid line for measuring fluid in the beverage fluid line and for generating a first measurement signal;

a conductivity sensing unit engaged with the beverage fluid line for measuring fluid in the beverage fluid line and for generating a second measurement signal; and a processor linked with the photoelectric device and the conductivity sensing units for receiving the first and the second measurement signals.

31. The beverage dispenser sensor system according to claim 30 wherein the processor ensures the photoelectric device sensing unit and the conductivity sensing unit are in cooperative engagement.

32. The beverage dispenser sensor system according to claim 30 wherein the photoelectric device comprises:

a phototransmitter linked with the processor and in engagement with beverage fluid within the beverage fluid line for emitting an electromagnetic radiation signal through beverage fluid; and a photodetector linked with the processor and in engagement with beverage fluid within the beverage fluid line for receiving the electromagnetic radiation signal.

33. The beverage dispenser sensor system according to claim 32 wherein the photoelectric device further comprises.

a support for the phototransmitter and the photodetector; and a housing for the support, wherein the housing and the support maintain the phototransmitter and the photodetector positioned about the beverage fluid line.

34. The beverage dispenser sensor system according to claim 30 wherein the conductivity sensing unit comprises:

a first electrode and a second electrode each in engagement with beverage fluid within the beverage fluid line and linked with the processor; and an electrolyte intermediate the first and second electrodes for establishing a conducting path therebetween.

35. The beverage dispenser sensor system according to claim 34 wherein the electrolyte comprises beverage fluid in the beverage fluid line.

36. The beverage dispenser sensor system according to claim 30 wherein the processor assesses beverage fluid level from the photoelectric device and the conductivity sensing unit measurement signals and generates a corresponding indicator signal.

37. The beverage dispenser sensor system according to claim 36 wherein the indicator announces that beverage fluid needs to be replenished if the processor assesses from the indicator signal little or a lack of beverage fluid in the beverage fluid line.

38. The beverage dispenser sensor system according to claim 36 further comprising an indicator linked with the processor for receiving indicator signals therefrom.

39. The beverage dispenser sensor system according to claim 38 wherein the indicator indicates the operational status of the beverage dispenser as a function of fluid within the beverage fluid line.

* * * * *